United States Patent [19]

Muck et al.

[11] 4,325,198

[45] Apr. 20, 1982

[54] CARTRIDGE LOAD FOR REVOLVERS

[76] Inventors: Gerhard Muck, Peter Jordanstr. 159, A 1180 Wien; Kurt Peter, Donaustr. 101/102, A 2344 Maria Enzersdorf-Südstadt, both of Austria

[21] Appl. No.: 33,223

[22] Filed: Apr. 25, 1979

[30] Foreign Application Priority Data

Apr. 27, 1978 [AT] Austria ..... 3038/78

[51] Int. Cl.[3] ..... F42B 39/04

[52] U.S. Cl. ..... 42/89

[58] Field of Search ..... 42/89

[56] References Cited

U.S. PATENT DOCUMENTS 684,752 10/1901 Garfield et al. ..... 42/89

913,393 2/1909 Kellogg ..... 42/89

2,073,436 3/1937 Woodhead ..... 42/89

3,213,559 10/1965 Matich ..... 42/89

3,523,383 8/1970 Sposimo ..... 42/89

*Primary Examiner*—Charles T. Jordan

*Attorney, Agent, or Firm*—Montague & Ross

[57] ABSTRACT

A cartridge load for a revolver comprises a plurality of angularly spaced cartridges distributed in a circle, each having a respective casing, powder charge and bullet, with the casings being interconnected at their peripheries by thin flexible ligatures which are formed unitarily, i.e. in one piece, with the material of the casing so that the cartridges collectively form a ring which is limitedly expandable to fit into the drum or cylinder bores of different makes of revolvers.

6 Claims, 5 Drawing Figures

CARTRIDGE LOAD FOR REVOLVERS

FIELD OF THE INVENTION

The present invention relates to a cartridge load for a revolver cylinder or drum and, more particularly, to a revolver load comprising a plurality of cartridges.

BACKGROUND OF THE INVENTION

A revolver generally comprises a drum or cylinder provided with a multiplicity of angularly equispaced bores which are each adapted to receive a respective cartridge and to be successively aligned, by the drum-stepping mechanism, with the barrel and hammer of the revolver. As each cartridge is fired, its shell remains in the barrel and can be ejected individually, or in some cases simultaneously with the other spent cartridge casings, through the use of an ejectormechanism of the drum.

Naturally the individual insertion of fresh cartridges each consisting of a shell or casing receiving the powder charge, and the primer and bullet which is to be discharged from the barrel, it time-consuming and burdensome. Hence it has been proposed to facilitate loading of the revolver by providing a ring or disk into which the cartridges are previously fitted to form a crown of cartridges held together by the ring or disk and which can then be inserted into the drum.

This ring or disk also can enable the simultaneous withdrawal of all of the spent casings or shells once the weapon has been fully discharged.

While such rapid-loading devices have proved to be somewhat effective, whether or not an insertion tool or device must additionally be used to fit the set of cartridges into place, difficulties have been encountered because of the relatively large dimensions (e.g. thickness and diameter) of the ring or of the rapid loading unit as a whole. Furthermore, the unit must be filled by hand or other tools so that again time-consuming processes may be involved.

Yet another disadvantage of earlier cartridge-receiving ring systems is that they are usually monodimensional, i.e. are suited for use only with a particular make of a revolver. In practice, different makes of revolvers for a given cartridge caliber may have the cartridge-receiving bores with different angular spacings or center-to-center spacings. Consequently, a particular rapid-loading unit may be suitable only for use with a given make of revolver or, at best, for a limited number of makes or constructions.

OBJECTS OF THE INVENTION

It is the principal object of this invention to provide an improved multi-cartridge load for a revolver which avoids the disadvantages of earlier rapid-loading systems as described.

A more specific object is to provide a multi-cartridge load for a revolver which can be accommodated to revolvers of different design and make and which does not require tools or the like for insertion of the load or the extraction of the spent load.

Another object of this invention is to provide a cartridge load of relatively small dimensions and which can cooperate with existing cartridge ejectors for rapid removal of the spent load.

It is also an object of the invention to provide a rapid-loading unit for the purposes described which does not require manual insertion of individual cartridges into a support.

SUMMARY OF THE INVENTION

These objects and others which will become apparent hereinafter are attained, in accordance with the present invention, in a rapid-loading device or unit, i.e. a cartridge load, for a revolver which comprises a plurality of angularly spaced mutually parallel cartridges whose rims terminate in a common plane and are interconnected with neighboring cartridges by relatively flexible ligatures or elements so that the group of cartridges are thereby interconnected into a cartridge ring.

According to an important feature of the invention the ligatures or elements are formed unitarily with the rims or ends of the shell casings or of the cartridges and can be straight or arcuate or angularly bent, the bent configuration facilitating the configuration to which the cartridges can be spread apart or contracted together to accommodate the unit to different makes of revolvers or sizes of revolver drums.

Since the ligatures connect the casing in a ring configuration with the cartridges disposed to correspond to the spacing of the revolver drum bores, no additional means is required to facilitate insertion of the load into the revolver drum.

The system of the invention, therefore, provides an especially rapid loading process.

The ejection of the load as a unit, when all of the cartridges have been spent, can be effected by the usual casing ejector provided in a revolver drum.

According to a feature of the invention, each of the cartridges can be formed with a rim having the configuration of a flange of generally circular outline with the ligature projecting laterally, e.g. tangentially or secantially therefrom.

The ligatures, apart from being deformable, can be elastic so as to contract the crown of cartridges into a smaller package until the cartridges are to be inserted into the revolver drum in which case the cartridges can be spread apart to accommodate different bore spacings of the revolver.

While the ligatures and the casings or shells can be formed unitarily (in one piece) from metal, it has been found to be advantageous to injection mold the piece from synthetic-resin material, e.g. a polyethylene.

The invention is also applicable to so-called rimless casings in which the ligatures simply project laterally of the casing in the plane of the firing end thereof.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
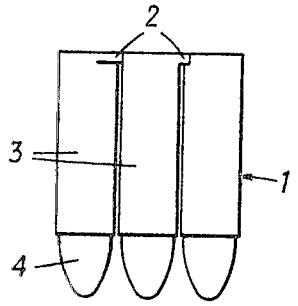
FIG. 1 is an elevational view of a rapid-load unit or cartridge load of the present invention.
Figure 2:
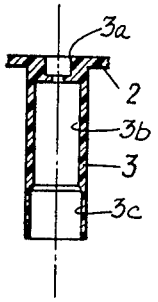
FIG. 2 is an axial section through a portion of a cartridge shown in FIG. 1, cutting through the ligatures thereof.

The cartridge ring shown in FIGS. 1 and 2 comprises six cartridges generally represented at 1, each of which has a rimless casing 3 and receives a bullet 4, the casing being filled with the propellant charge or powder in the usual manner.

Figure 3:
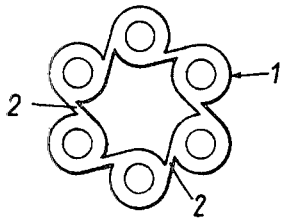
FIG. 3 is an end view of the unit of FIG. 1.

The six angularly equispaced cartridges 1 are interconnected by tangentially extending ligatures 2 which are thin pieces of the material from which the casings 3 are formed and, in the embodiment of FIGS. 1–3, are rectilinear.

Since each ligature 2 can bend inwardly and outwardly, the spread of the unit to accommodate different revolver drums or cylinders is permissible.

The casings 3 are preferably composed of synthetic resin as can be seen from FIG. 2 and can be provided with a recess 3*a* accommodating the usual primer, a chamber 3*b* for the powder charge, and a seat 3*c* into which the bullet can be press-fitted. In this case, the bullet may have a diameter slightly larger than the inner diameter of the seat 3*c*.

Figure 4:
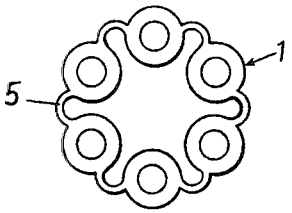
FIG. 4 is an end view of a unit representing a modification.
Figure 5:
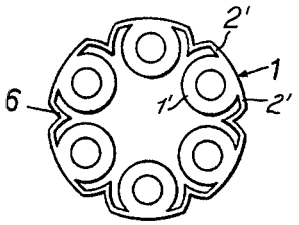
FIG. 5 is an end view of still another unit according to the invention.

In FIG. 5 we have shown another arrangement in which the rimless cartridges 1' have laterally projecting formations 2' which are tangential and which are interconnected by bent ligatures 6 to facilitate spreading of the cartridges. Spreading can also be facilitated by the use of arcuate ligatures as shown at 5. The bend can be inward (FIG. 5) or outward (FIG. 4).

While we prefer to form the ligatures unitarily with the casings of the cartridges, it should be apparent that there are modifications which, although not preferred, are compatible with the instant invention. For example, when the casings are composed of metal, although it is possible to form the ligatures of synthetic-resin strands which can be cemented or molded onto the casings. Conversely, the casing can be composed of synthetic-resin material with the ligatures formed unitarily therewith or, in a more expensive construction, composed of metal strands (preferably spring steel) which are embedded in the casing during the molding process.

We claim:

1. A cartridge load for a revolver cylinder having a plurality of angularly spaced cartridge-receiving bores, said load comprising a plurality of angularly spaced cartridges in number corresponding to the number of said bores and extending codirectionally from an end plane, and ligatures connecting each cartridge with a pair of adjacent cartridges to form an endless ring from said cartridges, each cartridge comprising a casing receiving a charge and a bullet, said ligatures being formed unitarily with and projecting from each casing at said plane, each of said ligatures being flexible and elastic to enable at least limited spreading of said cartridges to accommodate the load to various revolver cylinders.

2. The cartridge load defined in claim 1 wherein said ligatures and said casings are formed of synthetic-resin material.

3. The cartridge load defined in claim 1 wherein said ligatures are bent.

4. The cartridge load defined in claim 3 wherein said ligatures are angularly bent.

5. The cartridge load defined in claim 3 wherein said ligatures are arcuately bent.

6. The cartridge load defined in claim 3 wherein said ligatures extend tangentially from the respective casings.

* * * * *